US009926516B2

(12) United States Patent
Bettiol et al.

(10) Patent No.: US 9,926,516 B2
(45) Date of Patent: Mar. 27, 2018

(54) MONO ALCOHOLS FOR LOW TEMPERATURE STABILITY OF ISOTROPIC LIQUID DETERGENT COMPOSITIONS

(71) Applicant: The Procter & Gamble Company, Cincinnati, OH (US)

(72) Inventors: Jean-Luc Philippe Bettiol, Etterbeek (BE); Frederik Clara P Vandenberghe, Sint-Amands (BE)

(73) Assignee: The Procter & Gamble Company, Cincinnati, OH (US)

( * ) Notice: Subject to any disclaimer, the term of this patent is extended or adjusted under 35 U.S.C. 154(b) by 158 days.

(21) Appl. No.: 14/727,895

(22) Filed: Jun. 2, 2015

(65) Prior Publication Data

US 2015/0353868 A1 Dec. 10, 2015

Related U.S. Application Data

(60) Provisional application No. 62/008,458, filed on Jun. 5, 2014.

(51) Int. Cl.

| | |
|---|---|
| ***C11D 1/12*** | (2006.01) |
| ***C11D 1/65*** | (2006.01) |
| ***C11D 1/75*** | (2006.01) |
| ***C11D 1/88*** | (2006.01) |
| ***C11D 1/90*** | (2006.01) |
| ***C11D 3/20*** | (2006.01) |
| ***C11D 1/94*** | (2006.01) |

(52) U.S. Cl.

CPC ..... *C11D 3/201* (2013.01); *C11D 1/65* (2013.01); *C11D 1/94* (2013.01); *C11D 3/2006* (2013.01)

(58) Field of Classification Search

CPC .... C11D 1/12; C11D 1/65; C11D 1/75; C11D 1/88; C11D 1/90; C11D 3/2006

See application file for complete search history.

(56) References Cited

U.S. PATENT DOCUMENTS

| | | | | |
|---|---|---|---|---|
| 4,692,277 | A | 9/1987 | Siklosi | |
| 5,916,864 | A | 6/1999 | Fujino et al. | |
| 5,962,395 | A | 10/1999 | Puvvada et al. | |
| 6,432,897 | B1 * | 8/2002 | Cable | C11D 1/02 134/40 |
| 6,686,331 | B2 | 2/2004 | Trinh et al. | |
| 6,692,536 | B1 | 2/2004 | Masschelein et al. | |
| 2002/0037825 | A1 | 3/2002 | Demeyere et al. | |
| 2002/0128170 | A1 | 9/2002 | DeClercq et al. | |
| 2003/0139313 | A1 | 7/2003 | Turner et al. | |
| 2004/0119048 | A1 | 6/2004 | Zhu et al. | |
| 2004/0214743 | A1 | 10/2004 | Demeyere et al. | |

(Continued)

FOREIGN PATENT DOCUMENTS

| | | |
|---|---|---|
| EP | 0 506 312 A1 | 3/1992 |
| EP | 0 616 027 A1 | 9/1994 |

(Continued)

OTHER PUBLICATIONS

International Search Report for International Application Serial No. PCT/US2015/034426, dated Nov. 9, 2015, 13 pages.

*Primary Examiner* — Brian P Mruk

(74) *Attorney, Agent, or Firm* — Lauren Christine Gonzalez; Amy I. Ahn-Roll

(57) ABSTRACT

Certain alkyl mono-alcohols provide low temperature stability benefits to isotropic liquid detergent compositions.

11 Claims, 1 Drawing Sheet

| Component (wt%) | Inventive | | | | Comparative | | | | |
|---|---|---|---|---|---|---|---|---|---|
| | Ex. 1 | Ex. 2 | Ex. 3 | Ex. 4 | Ex. 5 | Ex. 6 | Ex. 7 | Ex. 8 | Ex. 9 |
| Surfactant Mixture [A] | 31.25 | 31.25 | 31.25 | 31.25 | 31.25 | 31.25 | 31.25 | 31.25 | 31.25 |
| Sodium Chloride | 1 | 1 | 1 | 1 | 1 | 1 | 1 | 1 | 1 |
| Sodium Cumene Sulfonate | 1.5 | 1.5 | 1.5 | 1.5 | 1.5 | 1.5 | 1.5 | 1.5 | 1.5 |
| Ethanol | 0.93 | 1.85 | 0.93 | 1.85 | | 1.93 | 2.85 | 4.40 | 6.00 |
| 1-Hexanol | 1 | 1 | | | | | | | |
| 2-Ethyl-1-Hexanol | | | 1 | 1 | | | | | |
| | | | | | | | | | |
| Data: | | | | | | | | | |
| Viscosity (cps) [B] | 1,004 | 775 | 834 | 659 | 3,400 | 2,010 | 1,472 | 840 | 475 |
| Appearance at room temp.[C] | ok | ok | ok | ok | ok | ok | ok | ok | ok |
| Stability at 0°C for 3 days[D] | ok | ok | ok | ok | solid opaque | solid translucent | solid translucent | liquid translucent | ok |
| Stability at -3°C for 3 days[E] | liquid translucent | liquid translucent | ok | ok | solid opaque | solid opaque | solid opaque | liquid opaque | liquid opaque |

(56) References Cited

U.S. PATENT DOCUMENTS

| | | | |
|---|---|---|---|
| 2006/0258555 | A1 | 11/2006 | Filippini et al. |
| 2007/0155647 | A1 | 7/2007 | Demeyere et al. |
| 2012/0129937 | A1 | 5/2012 | Issleib et al. |
| 2012/0164086 | A1 | 6/2012 | Araki et al. |

FOREIGN PATENT DOCUMENTS

| | | | | | |
|---|---|---|---|---|---|
| JP | 2002-020791 | | * | 1/2002 | ..... C11D 3/20 |
| JP | 2002020791 | A | | 1/2002 | |
| JP | 2004-091522 | A | | 3/2004 | |
| JP | 2007-332303 | A | | 12/2007 | |
| JP | 2007-332304 | A | | 12/2007 | |
| JP | 2013-203775 | A | | 10/2013 | |
| WO | WO-2011/014241 | A1 | | 2/2011 | |

* cited by examiner

| Component (wt%) | Inventive | | | | Comparative | | | | |
|---|---|---|---|---|---|---|---|---|---|
| | Ex. 1 | Ex. 2 | Ex. 3 | Ex. 4 | Ex. 5 | Ex. 6 | Ex. 7 | Ex. 8 | Ex. 9 |
| Surfactant Mixture [A] | 31.25 | 31.25 | 31.25 | 31.25 | 31.25 | 31.25 | 31.25 | 31.25 | 31.25 |
| Sodium Chloride | 1 | 1 | 1 | 1 | 1 | 1 | 1 | 1 | 1 |
| Sodium Cumene Sulfonate | 1.5 | 1.5 | 1.5 | 1.5 | 1.5 | 1.5 | 1.5 | 1.5 | 1.5 |
| Ethanol | 0.93 | 1.85 | 0.93 | 1.85 | | 1.93 | 2.85 | 4.40 | 6.00 |
| 1-Hexanol | 1 | 1 | | | | | | | |
| 2-Ethyl-1-Hexanol | | | 1 | 1 | | | | | |
| | | | | | | | | | |
| Data: | | | | | | | | | |
| Viscosity (cps) [B] | 1,004 | 775 | 834 | 659 | 3,400 | 2,010 | 1,472 | 840 | 475 |
| Appearance at room temp.[C] | ok | ok | ok | ok | ok | ok | ok | ok | ok |
| Stability at 0°C for 3 days[D] | ok | ok | ok | ok | solid opaque | solid translucent | solid translucent | liquid translucent | ok |
| Stability at -3°C for 3 days[E] | liquid translucent | liquid translucent | ok | ok | solid opaque | solid opaque | solid opaque | liquid opaque | liquid opaque |

MONO ALCOHOLS FOR LOW TEMPERATURE STABILITY OF ISOTROPIC LIQUID DETERGENT COMPOSITIONS

FIELD OF THE INVENTION

The present invention is directed to liquid detergent compositions. The instant application claims priority to Provisional Ser. No. 62/008,458, filed on Jun. 5, 2014.

BACKGROUND OF THE INVENTION

Users of isotropic liquid detergent compositions expect these compositions to be phase stable. These compositions are often shipped to retail stores or end users from the factory. Beyond the compositions can be stored in warehouses or at consumers' homes prior to being consumed. As such the composition can get exposed to cold temperature, both under shipping or storing conditions. A challenge with shipping or storing in cold temperature climates is that isotropic liquid detergent compositions can become unstable after being exposed to cold temperatures (e.g., 0° C. or below) and do not necessary recover at ambient temperatures. Many isotropic liquid detergent compositions contain certain alkyl sulphate surfactants or other certain surfactant systems that generally have poor solubility at cold temperatures (i.e., a high Kraft point). One symptom of this poor solubility is these compositions become phase unstable as evidenced by the compositions becoming cloudy or even beginning to form solid precipitates. These insolubility issues can be exacerbated by including cationic components such as co-surfactant (e.g., cationic, amphoteric or zwitterionic surfactants) or salts. Accordingly, there is a need to provide an isotropic liquid detergent compositions that are low temperature stable evidenced by demonstrating phase stability after low temperature exposure.

SUMMARY OF THE INVENTION

The present invention is based on the surprising discovery that certain alkyl mono-alcohols provide low temperature stability to isotropic liquid detergent composition evidenced by the compositions not becoming phase unstable after low temperature exposure (e.g., zero degrees Celsius or lower).

The present invention provides a number of potential advantages. One advantage is having a composition that is phase stable after having exposure to low temperatures. Another advantage is having the composition that remains clear or transparent, notwithstanding dyes, pigments, opacifiers and the like, after having exposure to low temperatures. Another advantage is using less of a total solvent system to achieve low temperature stability (thereby providing cost savings) and/or better neat product viscosity control. Another advantage is providing one or more of the aforementioned advantages in a highly concentrated surfactant system. Another advantage is minimizing the amount of solvents (to achieve one or more of the aforementioned advantages).

Accordingly, one aspect of the invention provides an isotropic liquid detergent composition comprising: (a) 0.1% to 15%, preferably from 0.3% to 10%, of a mono-alcohol having a $C_5$-$C_8$ linear backbone, and optionally substituted with one or more $C_1$-$C_5$ alkyl branching groups, by weight of the composition; (b) sulphonate surfactant; (c) co-surfactant, wherein the co-surfactant is selected from the group consisting of a cationic surfactant, an amphoteric surfactant, a zwitterionic surfactant, and mixtures thereof; and (d) water.

Another aspect of the invention provides for isotropic liquid detergent composition comprising: (a) 0.1% to 15%, preferably from 0.3% to 10% of a mono-alcohol having a $C_5$-$C_8$ linear backbone, and optionally substituted with one or more $C_1$-$C_5$ alkyl branching groups, by weight of the composition; (b) alkyl sulphate surfactant, wherein the alkyl sulphate surfactant has the formula: $R_1O(A)_xSO_3M$, wherein: $R_1$ is a $C_1$-$C_{21}$ alkyl or alkenyl group, preferably from $C_8$-$C_{20}$; A is an alkoxy group, preferably a $C_1$-$C_5$ alkoxy group, more preferably a $C_1$-$C_3$ alkoxy group; x represents mole percentage average from 0 to 10, preferably 0.01 to 10; and M is an cation, preferably the cation is selected from an alkali metal, alkali earth metal, ammonium group, or alkanolammonium group; and (c) water.

Yet another aspect of the invention provides for an isotropic dish detergent composition comprising: (a) 0.4% to 5%, preferably from 0.5% to 3% of a mono-alcohol having a $C_5$-$C_8$ linear backbone, and optionally substituted with one or more $C_1$-$C_2$ alkyl branching groups; (b) 1% to 40% of an alkyl sulphate surfactant by weight of the composition, wherein the alkyl sulphate surfactant having the formula: $R_1O(A)_xSO_3M$, wherein: $R_1$ is a $C_{10}$-$C_{18}$ alkyl or alkenyl group; A is an alkoxy group selected from ethoxy, propoxy, mixtures thereof; x represents mole percentage average from 0.1 to 0.9; and M is an cation, wherein the cation is selected from an alkali metal, alkali earth metal, ammonium group, or alkanolammonium group; and (c) water is from 10% to 95%, preferably from 20% to 95%, by weight of the composition. In one embodiment of said isotropic dish detergent composition, the mono-alcohol is selected from 2-ethylhexan-1-ol, methyloctanol, dimethyloctanol, 6-methyl heptan-1-ol, 3,7-dimethyloctanol, 1-hexanol, 1-heptanol, 2-hexanol, 2-heptanol, and mixtures thereof; and the composition further comprises a co-surfactant, wherein the co-surfactant is an amine oxide. Preferably, said embodiment comprises: (a) the mono-alcohol is 2-ethylhexan-1-ol (preferably from 0.5% to 3% by weight of the composition); (b) the alkyl sulphate is from 6% to 35% by weight of the composition, wherein the alkyl sulphate is a mixture of an alkyl non-alkoxy sulfate and an alkyl alkoxy sulfate; (c) the amine oxide is an alkyldimethylamine oxide; (d) the water is from 30% to 90% by weight of the composition; (e) the composition further comprises from 0.1% to 3% of a hydrotrope by weight of the composition, wherein the hydrotrope is selected from sodium, potassium, and ammonium xylene sulfonate, sodium, potassium and ammonium toluene sulfonate, sodium potassium and ammonium cumene sulfonate, and mixtures thereof; and (f) pH is from 8 to 10. In another embodiment, the composition comprises from 0.5% to 4% ethanol by weight of the detergent composition.

Yet still another aspect of the invention provides for a use of a composition according the present invention to achieve phase stability after subjecting the composition to a temperature of 0° C. or lower. The exposure may be for 3 days, 5 days, or 28 days. The temperature may be zero degrees Celsius or may be minus three degrees Celsius, preferably below zero degrees Celsius, more preferably at −3° C. for at least three days.

BRIEF DESCRIPTION OF THE DRAWINGS

FIG. 1 provides formulations and data for inventive and comparative examples. Phase stability at low temperatures is assessed.

DETAILED DESCRIPTION OF THE INVENTION

Isotropic

The term "isotropic" is a single phase composition that is clear or transparent, assessed in absence of opacifiers, pigments, dyes, and the like. More particularly within aqueous liquid detergent compositions it means there is no discrete separate organic phase dispersed within the main aqueous phase. An isotropic composition is distinguished from water-in-oil emulsions, oil-in-water emulsions including microemulsions and lamellar phase compositions. Polarized light microscopy can assess whether the composition is isotropic. See e.g., *The Aqueous Phase Behaviour of Surfactants*, Robert Laughlin, Academic Press, 1994, pp. 538-542. More advanced techniques include XRD and SAXS. See e.g., A. Svensson, et al, J. Phys. Chem B, 106, 1013 (2002); K. Fontell, Colloid Polymer Sci. 268, 264 (1990); *Colloids Surfaces A: Physicochemical and Engg Aspects;* 358, (2010), 50-56.

Liquid Detergent

As used herein "liquid detergent composition" refers to those compositions that are employed in a variety of cleaning uses including dishes, or hard surfaces (e.g., floors, countertops etc), laundry, hair (e.g., shampoos), body, and the like. A preferred liquid detergent composition of the present invention is a "liquid dish detergent composition," which refers to those compositions that are employed in manual (i.e. hand) dish washing. Such compositions are generally high sudsing or foaming in nature. By "dish," the term includes dishes, glasses, pots, pans, baking dishes, flatware and the like, made from ceramic, china, metal, glass, plastic (polyethylene, polypropylene, polystyrene, etc.), wood and the like.

Alkyl Mono-Alcohol

The present invention is based on the surprising discovery that certain mono-alcohols provide low temperature stability, to isotropic liquid detergent compositions described herein, as evidenced by not having phase separation, especially precipitation, after low temperature exposure (e.g., 0° C. or below). The single alcohol moiety may be a primary or secondary or tertiary alcohol.

The primary alcohols, of the mono-alcohols of the present invention, have a $C_5$-$C_8$ linear backbone, and optionally substituted with one or more $C_1$-$C_5$ alkyl branching groups. When substituted, the primary mono-alcohol is preferably substituted with methyl or ethyl groups, and more preferably is substituted with one or two of said methyl or ethyl groups. For purposes of clarification, the primary mono-alcohol of the present invention has the single alcohol moiety bonded directly to said $C_5$-$C_8$ linear backbone in terminal position. Preferred unsubstituted (i.e., linear) primary mono-alcohols are from 5 to 8 total carbons, preferably from 6 to 7 total carbons. Specifically preferred unsubstituted mono-alcohols include primary alcohols 1-hexanol and 1-heptanol.

The secondary or tertiary alcohols, of the mono-alcohols of the present invention, have a $C_5$-$C_8$ linear backbone substituted with a $C_1$-$C_5$ alkyl branching group in the C1 position, i.e. the carbon atom to which the hydroxyl (—OH) group is also bound, optionally further comprising one or more substituting $C_1$-$C_5$ alkyl branching groups on any of the linear backbone or the $C_1$-$C_5$ alkyl branching group in the C1 position. Specifically preferred secondary alcohols of the present invention include 2-hexanol and 2-heptanol.

Substituted mono-alcohols (i.e., having alkyl branching groups) of the present invention are preferred over unsubstituted ones. Preferred substituted mono-alcohols of the present invention include ethylhexanol, methyloctanol, dimethyloctanol, methylheptanol, dimethyl octanol, preferably, 2-ethylhexan-1-ol, methyloctanol, dimethyloctanol, 6-methyl heptan-1-ol, 3,7-dimethyloctanol, more preferably 2-ethylhexan-1-ol. The substituted alcohols are preferred because, without wishing to be bound by theory, additional surfactant depacking effect is provided given the sterical hindrance provided by the branching. Accordingly, less of the substituted mono-alcohol can be used compared to the unsubstituted mono-alcohol. In one embodiment, the total number of carbons of the substituted mono-alcohols (i.e. backbone+branching) of the present invention is from 6 to 13, preferably 6 to 11 total carbons, alternatively 7 to 10 total carbons, or combinations thereof. In yet another embodiment, a mixture of substituted and unsubstituted mono-alcohols of the present invention is used.

An effective amount of mono-alcohol of the present invention may be used to achieve the phase stability of the detergent composition after low temperature exposure. In one embodiment, the detergent compositions of the present invention comprises from 0.1% to 15%, preferably from 0.2% to 10%, more preferably from 0.3% to 10%, alternatively from 0.4% to 5%, or from 0.5% to 3%, or from 0.6% to 2%, or from 0.7% to 1.8%, or from 1% to 2%, or from 1% to 3%, or from 0.5% to 2%, or 0.1% to 3%, or from 0.2% or 2%, or from 1% to 6%, or from 1% to 15%, alternatively combinations thereof, by weight of the detergent composition.

Without wishing to be bound by theory, mono-alcohols of the present invention may provide the advantages described herein by having a carbon chain length which is short enough to destabilize surfactant packing under low temperature conditions, while long enough to facilitate surfactant packing at finished product surfactant concentrations.

Due to their relatively higher water solubility and hence decreased distribution in the surfactant phase compared to higher carbon chain lengths, lower carbon length alcohols, such as ethanol, are not efficient in providing the effect thereby requiring significantly more of the lower carbon chain length alcohol to provide the same effect as provided by the mono-alcohols of the present invention. However, if this carbon chain length is too long, then the alcohol may co-pack with the anionic surfactant even at low temperature thereby inducing phase separation potentially even faster.

Surfactant(s)

One aspect of the invention provides the use of the mono-alcohols of the present invention with an alkyl sulphate surfactant, optionally further comprising a co-surfactant (and optionally a nonionic surfactant), wherein the co-surfactant is selected from the group consisting of a cationic surfactant, amphoteric surfactant, a zwitterionic surfactant, and mixtures thereof. Another aspect of the invention provides the use of the mono-alcohols of the present invention in a surfactant system, wherein the surfactant system comprises at least a sulphonate surfactant and a co-surfactant (and optionally a nonionic surfactant), wherein the co-surfactant is selected from the group consisting of cationic surfactant, amphoteric surfactant, a zwitterionic surfactant, and mixtures thereof.

Alkyl Sulphate Surfactant

One aspect of the invention provides an alkyl sulphate surfactant of the formula defined below, preferably comprising from 0.1% to 50%, preferably from 1% to 40%, more preferably from 6% to 35%, yet more preferably from 8% to 30%, alternatively combinations thereof, by weight of the detergent composition.

The alkyl sulphate surfactant of the present invention have the formula: $R_1O(A)_xSO_3M$, wherein the variable are herein defined. "$R_1$" is a $C_1$-$C_{21}$ alkyl or alkenyl group, preferably from $C_8$-$C_{20}$, more preferably from $C_{10}$-$C_{18}$. The alkyl or alkenyl group may be branched or linear. The mono-alcohols of the present invention are particularly beneficial to those alkyl sulphate surfactants having a linear alkyl or alkenyl group because these surfactants typically have a higher Kraft point than those surfactants having a branched $R_1$, and therefore are more susceptible to phase stability issues after low temperature exposure. Accordingly, the mono-alcohols of the present invention are particularly beneficial in providing phase stability after low temperature exposure benefits to those formulations contain these alkyl surfactants have linear alkyl or alkenyl groups as $R_1$.

Turning to those surfactants where the alkyl or alkenyl group of $R_1$ are branched, the alkyl or alkenyl group preferably comprises $C_{1-4}$ alkyl branching units. The average weight percentage branching of the alkyl sulphate surfactant is preferably greater than 10%, more preferably from 15% to 80%, and most preferably from 20% to 40%, alternatively from 21% to 28%, alternatively combinations thereof. The branched alkyl sulphate surfactant can be a single alkyl sulphate surfactant or a mixture of alkyl sulphate surfactants. In the case of a single surfactant, the percentage of branching refers to the weight percentage of the hydrocarbyl chains that are branched in the original alcohol from which the surfactant is derived. In the case of a surfactant mixture, the percentage of branching is the weight average and it is defined according to the following formula: Weight average of branching (%)=[(x1*wt % branched alcohol 1 in alcohol 1+x2*wt % branched alcohol 2 in alcohol 2+ . . . )/(x1+x2+ . . . )]*100; wherein x1, x2, . . . are the weight in grams of each alcohol in the total alcohol mixture of the alcohols which are used as starting material for the anionic surfactant. In the weight average branching degree calculation, the weight of alkyl sulphate surfactant components not having branched groups should also be included.

Turning back to the above formula, "A" is an alkoxy group (if present), preferably a $C_1$-$C_5$ alkoxy group, more preferably a $C_1$-$C_3$ alkoxy group, yet more preferably the alkoxy group is selected from ethoxy, propoxy, and mixtures thereof. In one embodiment, the alkoxy group is ethoxy. "x" represents a mole percentage average from 0 to 10, alternatively from 0.01 to 10, preferably from 0.1 to 8, alternatively from 1 to 5, alternatively below 1. When x is below 1, preferably x is from 0 to below 1, more preferably from 0.1 to 0.9, alternatively from 0.2 to 0.8, alternatively combinations thereof.

For purposes of clarification, when x is 0, there are no alkoxy groups, i.e., an alkyl non-alkoxy sulfate. However, when x is greater than 0, the formula above describes certain alkyl alkoxy sulfates; more preferably the formula describes a mixture of alkyl non-alkoxy sulfates and alkyl alkoxy sulfates such that the alkoxylation on mole percentage average (i.e., variable "x") is greater than 0. In the case of a surfactant mixture, the average degree of alkoxylation is the mole percent average and it is defined according to the following formula: Mole average degree of alkoxylation=[y0*0+y1*1+y2*2+ . . . )/(y0+y1+y2+ . . . )]; wherein y0, y1, y2, . . . are the mole percent of each sulphated surfactant in the total alkyl mixture of sulphated surfactants having respectively 0, 1, 2, . . . alkoxy units which are present in the detergent of the invention. For example, an alkyl non-alkoxy sulphate of the following formula $CH_3(CH_2)_{13}SO_4Na$ will have a y value of 0 (i.e., y0). An alkylethoxysulfate of the following formula $CH_3(CH_2)_{13}(OCH_2CH_2)SO_4Na$ will have a y value of 1 (i.e., y1). An alkylethoxysulfate of the following formula: $CH_3(CH_2)_{10}(OCH_2CH_2)_4SO_4Na$ will have a y value of 4 (i.e., y4). The mole amount of each the three molecules is taken into account to ultimately calculate the mole percentage average of variable "x" (in the formula $R_1O(A)_xSO_3M$).

Alkyl non-alkoxy surfactants have relatively high Kraft points and thus are particularly sensitive to phase stability issues after low temperature exposure (relative to alkyl alkoxy surfactants). Many detergent compositions are formulated with these surfactants given its high performance grease cleaning. Accordingly, the mono-alcohols of the present invention are particularly beneficial in providing phase stability after low temperature exposure benefits to those formulations that comprise these alkyl non-alkoxy surfactants.

Regarding the formula $R_1O(A)_xSO_3M$, "M" is a cation, preferably the cation is selected from an alkali metal, alkali earth metal, ammonium group, or alkanolammonium group; more preferably the cation is sodium.

Surfactant System

One aspect of the invention provides the use of the mono-alcohols of the present invention and a surfactant system comprising at least a sulphonate surfactant and a co-surfactant, wherein the co-surfactant is selected from the group consisting of a cationic surfactant, an amphoteric surfactant, a zwitterionic surfactant, and mixtures thereof, and optionally a nonionic surfactant. In one embodiment, the liquid detergent composition comprises from 1% to 60%, preferably from 5% to 50%, more preferably from 8% to 40% of a surfactant system by weight of the liquid detergent composition.

Sulphonate Surfactant

The compositions of the present invention will preferably comprise 1% to 40%, preferably 6% to 32%, more preferably 8% to 25% of a sulphonate surfactant by weight of the detergent composition. Those include water-soluble salts or acids of $C_{10}$-$C_{14}$ alkyl or hydroxyalkyl, sulphonates; $C_{11}$-$C_{18}$ alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). Those also include the paraffin sulphonates may be monosulphonates and/or disulphonates, obtained by sulphonating paraffins of 10 to 20 carbon atoms. The sulfonate surfactant also includes the alkyl glyceryl sulphonate surfactants.

Beyond sulphate or sulphonate anionic surfactants, the detergent composition can optionally further comprise other anionic surfactants. Non-limiting examples include carboxylate, phosphate, phosphonate, sulfosuccinate and sulfoacetate anionic surfactants.

Co-surfactants

One aspect of the invention provides a co-surfactant (defined below) comprising from 0.1% to 20%, preferably from 0.5% to 15%, more preferably from 1% to 12%, alternatively from 2% to 10%, alternatively combination thereof, by weight of the detergent composition. The co-surfactant is selected from a cationic surfactant, an amphoteric surfactant, a zwitterionic surfactant, and mixtures thereof. In a preferred embodiment, the composition of the present invention will preferably comprise an amine oxide as the amphoteric surfactant or betaine as the zwitterionic surfactant, or a mixture of said amine oxide and betaine surfactants.

Preferably the co-surfactant comprises an amphoteric surfactant and wherein the amphoteric surfactant comprises at least 40%, preferably at least 50%, more preferably at least 60% by weight of an amine oxide surfactant. Alternatively the primary co-surfactant comprises an amphoteric and a zwitterionic surfactant and wherein the amphoteric and the zwitterionic surfactant preferably are in a weight ratio of from about 2:1 to about 1:2, more preferably wherein the amphoteric surfactant is an amine oxide surfactant and the zwitteronic surfactant is a betaine. Most preferably the co-surfactant is an amine oxide, especially alkyl dimethyl amine oxide.

Most preferred among the amphoteric surfactants are amine oxides, especially coco dimethyl amine oxide or coco amido propyl dimethyl amine oxide Amine oxide may have a linear or mid-branched alkyl moiety. Typical linear amine oxides include water-soluble amine oxides containing one $R_1$ $C_{8-18}$ alkyl moiety and 2 $R_2$ and $R_3$ moieties selected from the group consisting of $C_{1-3}$ alkyl groups and $C_{1-3}$ hydroxyalkyl groups. Preferably amine oxide is characterized by the formula $R_1$—$N(R_2)(R_3)O$ wherein $R_1$ is a $C_{8-18}$ alkyl and $R_2$ and $R_3$ are selected from the group consisting of methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides. As used herein "mid-branched" means that the amine oxide has one alkyl moiety having $n_1$ carbon atoms with one alkyl branch on the alkyl moiety having $n_2$ carbon atoms. The alkyl branch is located on the α carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a $C_{1-3}$ alkyl, a $C_{1-3}$ hydroxyalkyl group, or a polyethylene oxide group containing an average of from about 1 to about 3 ethylene oxide groups. Preferably the two moieties are selected from a $C_{1-3}$ alkyl, more preferably both are selected as a $C_1$ alkyl.

Most preferred among the zwitterionic surfactants are betaines, such as alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R^3)—(CH_2)_m—[CH(OH)—CH_2]_y—Y— \quad \text{(I) wherein}$$

$R^1$ is a saturated or unsaturated C6-22 alkyl residue, preferably C8-18 alkyl residue, in particular a saturated C10-16 alkyl residue, for example a saturated C12-14 alkyl residue;

X is NH, $NR^4$ with C1-4 Alkyl residue $R^4O$ or S, n is a number from 1 to 10, preferably 2 to 5, in particular 3, x is 0 or 1, preferably 1, $R^2$, $R^3$ are independently a C1-4 alkyl residue, potentially hydroxy substituted such as a hydroxyethyl, preferably a methyl.

m is a number from 1 to 4, in particular 1, 2 or 3, y is 0 or 1, and

Y is COO, $SO_3$, $OPO(OR^5)O$ or P(O)(OR5)O, whereby $R^5$ is a hydrogen atom H or a C1-4 alkyl residue.

Preferred betaines are the alkyl betaines of the formula (Ia), the alkyl amido betaine of the formula (Ib), the Sulfo betaines of the formula (Ic) and the Amido sulfobetaine of the formula (Id);

$$R^1—N^+(CH_3)_2—CH_2COO^- \quad \text{(Ia)}$$

$$R^1—CO—NH(CH_2)_3—N^+(CH_3)_2—CH_2COO^- \quad \text{(Ib)}$$

$$R^1—N^+(CH_3)_2—CH_2CH(OH)CH_2SO_3— \quad \text{(Ic)}$$

$$R^1—CO—NH—(CH_2)_3—N^+(CH_3)_2—CH_2CH(OH)CH_2SO_3— \quad \text{(Id)}$$

in which $R^1$1 as the same meaning as in formula I. Particularly preferred betaines are the Carbobetaine [wherein $Y^-$=$COO^-$], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, Cocoamidopropyl betaines (Cocoamidopropylbetain).

The co-surfactant is selected from a cationic surfactant, amphoteric surfactant, zwitterionic surfactant, and mixtures thereof. In one embodiment, the amphoteric surfactant comprises at least 40%, preferably at least 50%, more preferably at least 60% of an amine oxide by weight of the amphoteric surfactant, and the zwitterionic surfactant is a betaine. In another embodiment, the co-surfactant comprises the amphoteric surfactant and the zwitterionic surfactant, wherein the amphoteric surfactant and the zwitterionic surfactant are preferably in a weight ratio of from 2:1 to 1:2, respectively. In another embodiment, the co-surfactant is the amphoteric surfactant and the zwitteronic surfactant, wherein the amphoteric surfactant is an amine oxide surfactant and the zwitteronic surfactant is a betaine, and the weight ratio of the amine oxide surfactant to the betaine is about 1:1. In another embodiment, the co-surfactant is an amine oxide surfactant; and wherein the nonionic surfactant is an alcohol ethoxylate nonionic surfactant. In yet another embodiment, the co-surfactant is an alkyldimethylamine oxide surfactant.

In one embodiment, the co-surfactant comprises a cationic surfactant. One non-limiting example of a cationic surfactant is quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Other preferred cationic surfactants include alkyl benzalkonium halides and derivatives thereof, such as those available from Lonza under the the BARQUAT and BARDAC tradenames. Another preferred cationic surfactant is a $C_6$-$C_{18}$ alkyl or alkenyl ester of a quaternary ammonium alcohol, such as quaternary chlorine esters. More preferably, the cationic surfactants have the formula (V):

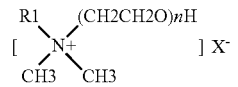

(V)

wherein R1 of formula (V) is $C_8$-$C_{18}$ hydrocarbyl and mixtures thereof, preferably, $C_{8-14}$ alkyl, more preferably, $C_8$, $C_{10}$ or $C_{12}$ alkyl, and X of formula (V) is an anion, preferably, chloride or bromide.

In a preferred alternative embodiment, the compositions of the present invention are free or substantially free of cationic surfactants.

Nonionic Surfactants

The detergent composition may comprise a nonionic surfactant, preferably comprising from 0.1% to 40%, preferably from 0.2% to 20%, more preferably from 0.5% to 10%, alternatively combination thereof, by weight of the detergent composition. Suitable nonionic surfactants include the condensation products of aliphatic alcohols with from 1 to 25 moles of alkylene oxide, preferably ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 8 to 18 carbon atoms, preferably from 10 to 15 carbon atoms, alternatively from 9 to 11 carbon atoms, alternatively from 12 to 14 carbon atoms, alternatively combinations thereof; with from 2 to 18 moles, preferably 2 to 15 moles, more preferably 5 to12 moles of ethylene oxide per mole of alcohol. In one embodiment, the nonionic surfactant is an aliphatic alcohol with from 1 to 25 moles of ethylene oxide, preferably condensation products of alcohols having an alkyl group containing from 8 to 18 carbon atoms, with from 2 to 18 moles of ethylene oxide per mole of alcohol.

Also suitable are alkylpolyglycosides having the formula $R^2O(C_nH_{2n}O)_t(\text{glycosyl})_x$ (formula (III)), wherein $R^2$ of formula (III) is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n of formula (III) is 2 or 3, preferably 2; t of formula (III) is from 0 to 10, preferably 0; and x of formula (III) is from 1.3 to 10, preferably from 1.3 to 3, most preferably from 1.3 to 2.7. The glycosyl is preferably derived from glucose. Also suitable are alkylglycerol ethers and sorbitan esters.

Also suitable are fatty acid amide surfactants having the formula (IV):

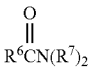

(IV)

wherein $R^6$ of formula (IV) is an alkyl group containing from 7 to 21, preferably from 9 to 17, carbon atoms and each $R^7$ of formula (IV) is selected from the group consisting of hydrogen, $C_1$-$C_4$ alkyl, $C_1$-$C_4$ hydroxyalkyl, and —$(C_2H_4O)_xH$ where x of formula (IV) varies from 1 to 3. Preferred amides are $C_8$-$C_{20}$ ammonia amides, monoethanolamides, diethanolamides, and isopropanolamides.

Most preferably the nonionic surfactant is a condensation product of an aliphatic alcohol with ethyleneoxide.

Water

The isotropic liquid detergent compositions of the present invention preferably comprise water. The water may be added to the composition directly or may be brought into the composition with raw materials. In any event, the total water content of the composition herein may comprise from 10% to 95% water by weight of the liquid dish detergent compositions. Alternatively, the composition may comprise from 20% to 95%, alternatively from 20% to 80%, or 30% to 70%, or 50% to 75%, or from 30% to 90%, or 40% to 85%, or 20% to 30%, alternatively combinations thereof, of water by weight of the liquid dish detergent composition.

Organic Solvents

The present compositions may optionally comprise an organic solvent. Suitable organic solvents include $C_{4-14}$ ethers and diethers, polyols, glycols, alkoxylated glycols, $C_6$-$C_{16}$ glycol ethers, alkoxylated aromatic alcohols, aromatic alcohols, $C_1$-$C_4$ aliphatic linear or branched alcohols, alkoxylated aliphatic linear or branched alcohols, alkoxylated $C_1$-$C_5$ alcohols, $C_8$-$C_{14}$ alkyl and cycloalkyl hydrocarbons and halohydrocarbons, and mixtures thereof. Preferably the organic solvents include $C_1$-$C_4$ alcohols; and glycols, and glycol ethers; alternatively $C_1$-$C_4$ alcohols and glycols. In one embodiment, the liquid detergent composition comprises from 0% to less than 50% of a solvent by weight of the composition. When present, the liquid detergent composition will contain from 0.01% to 20%, alternatively from 0.5% to 15%, alternatively from 1% to 10% by weight of the liquid detergent composition of said organic solvent. These organic solvents may be used in conjunction with water, or they may be used without water. Non-limiting examples of specific solvents include propylene glycol, polypropylene glycol, propylene glycol phenyl ether, ethanol, and combinations thereof. In one embodiment, the composition comprises from 0.01% to 20% of an organic solvent by weight of the composition, wherein the organic solvent is selected from glycols, polyalkyleneglycols, glycol ethers, ethanol, and mixtures thereof.

Hydrotrope

The liquid detergent compositions optionally comprises a hydrotrope in an effective amount, i.e. from 0% to 15%, or from 0.5% to 10%, or from 1% to 6%, or from 0.1% to 3%, or combinations thereof, so that the liquid dish detergent compositions are compatible or more compatible in water.

Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, as disclosed in U.S. Pat. No. 3,915,903. In one embodiment, the composition of the present invention is isotropic. An isotropic composition is distinguished from oil-in-water emulsions and lamellar phase compositions. Polarized light microscopy can assess whether the composition is isotropic. See e.g., *The Aqueous Phase Behaviour of Surfactants*, Robert Laughlin, Academic Press, 1994, pp. 538-542. In one embodiment, an isotropic dish detergent composition is provided. In one embodiment, the composition comprises 0.1% to 3% of a hydrotrope by weight of the composition, preferably wherein the hydrotrope is selected from sodium, potassium, and ammonium xylene sulfonate, sodium, potassium and ammonium toluene sulfonate, sodium potassium and ammonium cumene sulfonate, and mixtures thereof.

Calcium/Magnesium Ions

Calcium ion and/or Magnesium ion, preferably Magnesium ion, are added, preferably as a hydroxide, chloride, acetate, sulphate, formate, oxide or nitrate salt, to the compositions of the present invention, typically at an active level of from 0.01% to 1.5%, preferably from 0.015% to 1%, more preferably from 0.025% to 0.5%, by weight of the liquid detergent composition. In one embodiment, the composition comprises from 0.01% to 1.5% of a calcium ion or magnesium ion, or mixtures thereof, by weight of the composition, preferably the magnesium ion. Those detergent compositions comprising calcium ion and/or magnesium ion may particularly benefit from the mono-alcohols of the present invention. Although these ions may increase cleaning as a co-packing aid, these ions may also significant decrease phase stability after low temperature exposure.

Adjunct Ingredients

The liquid detergent compositions herein can optionally further comprise a number of other adjunct ingredients suitable for use in liquid detergent compositions such as perfume, colorants, pearlescent agents, opacifiers, suds stabilizers/boosters, cleaning and/or shine polymers, rheology modifying polymers, structurants, chelants, skin care actives, suspended particles, enzymes, anti-caking agents, viscosity trimming agents (e.g. salt such as NaCl and other mono-, di- and trivalent salts), preservatives and pH trimming and/or buffering means (e.g. carboxylic acids such as citric acid, HCl, NaOH, KOH, alkanolamines, phosphoric and sulfonic acids, carbonates such as sodium carbonates, bicarbonates, sesquicarbonates, borates, silicates, phosphates, imidazole and alike).

pH

The liquid detergent compositions herein preferably have a pH adjusted to between 3 and 14, more preferably between 4 and 13, more preferably between 6 and 12, most preferably between 8 and 10, alternatively from 8.5 to 9.5, alternatively combinations thereof. pH is determined by the liquid detergent composition diluted with deionized water making a 10% product concentration by weight (i.e., 10% product and 90% water, by weight). The pH of the composition can be adjusted using pH trimming and/or buffering means known in the art.

Viscosity

The liquid detergent compositions of the present invention can be in the form of a liquid, semi-liquid, cream, lotion or gel compositions and, in some embodiments, are intended for use as liquid hand dishwashing detergent compositions for direct or indirect application onto dishware. These compositions include single phase Newtonian or non-Newtonian products with a high shear viscosity of between 1 centipoises (cps) and 10,000 cps at 20° C. and, alternatively between 10 cps and 8000 cps, or between 200 cps and 5000 cps, or between 300 cps and 3000 cps, or between 400 and 2000 cps, or between 500 and 1750 cps, or between 1000 and 1500 cps, or 300 cps to 700 cps, or from 400 cps to 800 cps, alternatively combinations thereof.

Viscosity is measured with a BROOKFIELD DV-E viscometer, at 20° C., spindle number 31. The following rotations per minute (rpm) should be used depending upon the viscosity: between 300 cps to below 500 cps is at 50 rpm; between 500 cps to less than 1,000 cps is at 20 rpm; from 1,000 cps to less than 1,500 cps at 12 rpm; from 1,500 cps to less than 2,500 cps at 10 rpm; from 2,500 cps, and greater, at 5 rpm. Those viscosities below 300 cps are measured at 12 rpm with spindle number 18.

Viscosity can be modified by a viscosity modifier. One example of a viscosity modifier is the use of sodium chloride. Suitable levels of sodium chloride may include from 0.01% to 2.5%, or from 0.015% to 2%, or from 0.025% to 1.5%, or from 1% to 1.5%, or 0.1% to 0.5%, or combinations thereof by weight of the liquid detergent composition. Those detergent compositions comprising sodium chloride may particularly benefit from the mono-alcohols of the present invention. Sodium chloride may decrease phase stability of detergent compositions after low temperature exposure.

Packaging

The liquid detergent compositions of the present invention may be packed in any suitable packaging for delivering the liquid detergent composition for use. In one preferred embodiment, the package may be comprised of polyethylene terephthalate, high-density polyethylene, low-density polyethylene, or combinations thereof. Furthermore, preferably, the package may be dosed through a cap at the top of the package such that the composition exits the bottle through an opening in the cap. The cap may be a push-pull cap or a flip top cap.

Process of Cleaning/Treating a Dishware

Another embodiment of the present invention is directed to a process of cleaning dishes with a composition of the present invention. The process comprises the step(s) of applying the composition onto the dish surface, typically in diluted or neat form, and rinsing the dish.

In one embodiment of the present invention, the composition herein can be applied in its diluted form. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface. The contacting of cloth, sponge, or similar article to the dish surface is preferably accompanied by a concurrent scrubbing of the dish surface.

Another method of the present invention will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition. The absorbing device, and consequently the undiluted liquid dishwashing composition, is then contacted individually to the surface of each of the soiled dishes to remove said soiling. The contacting of the absorbing device to the dish surface is preferably accompanied by concurrent scrubbing.

Alternatively, the device may be immersed in a mixture of the hand dishwashing composition and water prior to being contacted with the dish surface, the concentrated solution is made by diluting the hand dishwashing composition with water in a small container that can accommodate the cleaning device.

In one embodiment, a method of cleaning a dish with a liquid dish detergent composition described herein, said method comprising the steps of applying the composition onto the dish or in a dish washing basin or a dish cleaning implement. In another embodiment, use of a composition described herein is used to achieve phase stability after subjecting the composition to a temperature of 0° C. or lower.

Data

Data is provided to illustrate the present invention. Specifically, FIG. 1 provides formulations and data for inventive and comparative examples. Regarding FIG. 1, examples 1-4 (i.e., Ex. 1 to Ex. 4) are detergent compositions of the present invention, whereas as Examples 5-9 (i.e., Ex. 5 to Ex. 9) are comparative ones. Components for each example are provided on a weight percentage basis (relative to the detergent composition).

As designed by footnote "A" in FIG. 1, the surfactant mixture for each example comprises 31.25 percent of total surfactant by weight of the detergent composition. In turn, the surfactant mixture itself comprises 13 percent by weight of the detergent composition of $C_{12}$-$C_{13}$ alkyl ethoxy sulphate with an average mole percentage of ethoxylation of 0.6, with average alkyl branching of about 24%-25% ("AES"). With respect to the AES surfactant, non-sulphated alcohol and alcohol ethoxylates are obtained from suppliers, wherein the appropriate ratios of each are mixed together internally (to achieve the appropriate ethoxylation and branching), and then the alcohol mixture is sulphated also internally (P&G). The surfactant mixture also contains the co-surfactant amine oxide, specifically 13 percent of $C_{12}$-$C_{14}$ alkyl dimethyl amine oxide ex ICL, by weight of the detergent composition. Lastly, the surfactant mixture contains 5.25 percent of a nonionic surfactant by weight of the detergent composition. Specifically the nonionic surfactant contains Greenbentin DE/080 ex Kolb and less than 1% of Lutensol™ XP80 ex BASF by weight of the composition.

Footnote B refers to viscosity. Viscosity values are determined according to the method described above.

The visual appearances of the compositions are assessed at an initial 20 degrees Celsius and after cooling at the indicated temperatures and duration. The compositions are assessed in a 100 ml cylindrical bottle having a diameter of about 4 cm and are made from a material that is completely transparent. The assessment is conducted by a naked or unaided eye. There are two basic features that are assessed for each composition. Firstly, whether the composition comprises solid precipitate, becomes solid, or remains fully liquid. Secondly is the composition transparent, translucent, or opaque. The term "translucent" means that there is some degree of turbidity visible in the subject composition. The term "opaque" means that the subject composition cannot be seen through. A composition that comprises solids or has become solid or is translucent or opaque is indicative of phase instability. Those compositions that comprise solids or have become solid and are opaque are the most phase unstable. A composition that is "transparent" and "liquid" is isotropic, i.e., phase stable. In the FIG. 1, an indication of "ok" refers to a desirable transparent and liquid composition, i.e., one that is isotropic.

Footnote C refers to the visual appearance of the compositions at 20 degrees Celsius, i.e., before being exposed to any low temperatures.

Footnote D refers to the visual appearance of the compositions after being exposed at zero degrees Celsius for three days.

Footnote E refers to the visual appearance of the compositions after being exposed to minus three degrees Celsius for three days.

The data of FIG. 1 demonstrates firstly that 2-ethyl-1-hexanol is better (i.e., more weight efficient) than 1-hexanol for phase stability benefits after the detergent composition is exposed to low temperatures. The 2-ethyl-1-hexanol is branched whereas 1-hexanol is not. Secondly, this demonstrates that both 2-ethyl-1-hexanol and 1-hexanol are much better at providing the phase stability benefit than ethanol alone or control example 5 (which does not contain any alcohols). Examples 6 to 9 contain increasing levels of ethanol but fail to provide phase stability benefits to the detergent compositions after low temperature exposure. Examples 1 and 2 have 1% 1-hexanol while varying the amount of ethanol. While phase stability is demonstrated after exposure at zero degree Celsius, a completely phase stable composition is not demonstrated at minus three degrees Celsius after three days exposure (given the "liquid translucent" observation). Examples 3 and 4 have 1% 2-ethyl-1-hexanol while varying the amount of ethanol. Phase stability is demonstrated after exposure at both temperatures. This suggests that 2-ethyl-1-hexanol is more efficient at providing phase stability benefits than 1-hexanol given the superior results at minus three degrees Celsius. Varying the amount of ethanol can affect the viscosity as demonstrated by the decrease in viscosity in the composition having more ethanol (i.e., comparing examples 3 and 4).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An isotropic liquid detergent composition comprising:

(a) 0.1% to 15% of a mono-alcohol having a $C_5$-$C_8$ linear backbone, and optionally substituted with one or more $C_1$-$C_5$ alkyl branching groups, by weight of the composition;

(b) sulphonate surfactant;

(c) co-surfactant, wherein the co-surfactant is an amphoteric surfactant and a zwitterionic surfactant, wherein the amphoteric surfactant is an amine oxide surfactant and wherein the zwitterionic surfactant is a betaine;

(d) water;

wherein the composition further comprises 0.5% to 10% of a hydrotrope by weight of the composition, wherein the hydrotrope is selected from sodium, potassium, and ammonium xylene sulfonate, sodium, potassium and ammonium toluene sulfonate, sodium potassium and ammonium cumene sulfonate, and mixtures thereof;

wherein the composition further comprises a nonionic surfactant, wherein the nonionic surfactant is an aliphatic alcohol with from 1 to 25 moles of alkylene oxide; and wherein the composition further comprises from 0.01% to 1.5% of a magnesium ion; and wherein the composition is phase stable either after: (i) cooling for 28 days at 0° C.; or (ii) cooling for three days at −3° C.

2. The composition of claim 1, wherein said mono-alcohol is from 0.4% to 5% of a primary alcohol by weight of the composition, wherein the primary alcohol is selected from the group consisting of 1-hexanol, 1-heptanol, and mixtures thereof.

3. The composition of claim 1, wherein said mono-alcohol is from 0.4% to 5% of a secondary or tertiary alcohol by weight of the composition, wherein the secondary or tertiary alcohol is selected from the group consisting of 2-hexanol, 2-heptanol, and mixtures thereof.

4. The composition of claim 1, wherein said mono-alcohol is further substituted with one or more $C_1$-$C_3$ alkyl branching groups, wherein said substituted mono-alcohol is selected from the group consisting of ethylhexanol, methyloctanol, dimethyloctanol, methylheptanol, dimethyloctanol, and mixtures thereof.

5. An isotropic liquid detergent composition comprising:

(a) 0.1% to 15% of a mono-alcohol having a $C_5$-$C_8$ linear backbone, and optionally substituted with one or more $C_1$-$C_5$ alkyl branching groups, by weight of the composition;

(b) alkyl sulphate surfactant, wherein the alkyl sulphate surfactant having the formula: $R_1O(A)_xSO_3M$, wherein:

a. $R_1$ is a $C_1$-$C_{21}$ alkyl or alkenyl group;

b. A is a $C_1$-$C_5$ alkoxy group;

c. x represents mole percentage average from 0.1 to 8; and d. M is an cation, wherein the cation is selected from an alkali metal, alkali earth metal, ammonium group, or alkanolammonium group;

(c) water;

wherein said alkyl sulphate surfactant comprises a mixture of alkyl non-alkoxy surfactant and alkyl alkoxy surfactant;

wherein the detergent composition further comprises a co-surfactant, wherein the co-surfactant is an amphoteric surfactant and a zwitterionic surfactant, wherein the amphoteric surfactant is an amine oxide surfactant and the zwitteronic surfactant is a betaine;

wherein the detergent composition further comprises 0.5% to 10% of a hydrotrope by weight of the composition, wherein the hydrotrope is selected from sodium, potassium, and ammonium xylene sulfonate, sodium, potassium and ammonium toluene sulfonate, sodium potassium and ammonium cumene sulfonate, and mixtures thereof;

wherein the detergent composition further comprises a nonionic surfactant, wherein the nonionic surfactant is an aliphatic alcohol with from 1 to 25 moles of ethylene oxide; and wherein the detergent composition further comprises from 0.01% to 1.5% of a magnesium ion.

6. The composition of claim 5, wherein said mono-alcohol is from 0.4% to 5% of a primary alcohol by weight of the composition, wherein the primary alcohol is selected from the group consisting of 1-hexanol, 1-heptanol, and mixtures thereof.

7. The composition of claim 5, wherein said mono-alcohol is from 0.4% to 5% of a secondary or tertiary alcohol by weight of the composition, wherein the secondary or tertiary alcohol is selected from the group consisting of 2-hexanol, 2-heptanol, and mixtures thereof.

8. The composition of claim 5, wherein said mono-alcohol is further substituted with one or more $C_1$-$C_3$ alkyl branching groups, wherein said substituted mono-alcohol is selected from the group consisting of ethylhexanol, methyloctanol, dimethyloctanol, methylheptanol, dimethyloctanol, and mixtures thereof.

9. The composition of 5, wherein the composition is phase stable: after cooling for 28 days at 0° C. or after cooling for three days at −3° C.; and wherein the pH of the composition is from 8 to 10.

10. The composition of claim 5, wherein said mono-alcohol is selected from 2-ethylhexan-1-ol, methyloctanol, dimethyloctanol, 6-methyl heptan-1-ol, 3,7-dimethyloctanol, 1-hexanol, 1-heptanol, 2-hexanol, 2-heptanol, and mixtures thereof.

11. The composition of claim 5, wherein:

(a) the mono-alcohol is 2-ethylhexan-1-ol and is from 0.5% to 3% by weight of the composition;

(b) the alkyl sulphate is from 6% to 35% by weight of the composition, wherein the alkyl sulphate is a mixture of an alkyl non-alkoxy sulfate and an alkyl alkoxy sulfate;

(c) the amine oxide is an alkyldimethylamine oxide;

(d) the water is from 30% to 90% by weight of the composition;

(e) the hydrotope is from 0.1% to 3% by weight of the composition, and (f) pH is from 8 to 10.

* * * * *